US005603390A

United States Patent [19]

Foschini et al.

[11] Patent Number: 5,603,390

[45] Date of Patent: Feb. 18, 1997

[54] CONTROL SYSTEM FOR AN ELEVATOR

[75] Inventors: Gianluca Foschini, Cervia; Renzo Toschi, Bologna, both of Italy

[73] Assignee: Otis Elevator Company, Farmington, Conn.

[21] Appl. No.: 430,950

[22] Filed: Apr. 28, 1995

[51] Int. Cl.[6] ..... B66B 9/04

[52] U.S. Cl. ..... 187/275; 187/394

[58] Field of Search ..... 187/394, 399, 187/393, 275

[56] References Cited

U.S. PATENT DOCUMENTS

| | | | |
|---|---|---|---|
| 3,720,292 | 3/1973 | Magee | 187/393 |
| 4,418,794 | 12/1983 | Manco | 187/17 |
| 4,700,748 | 8/1987 | Fossati et al. | 137/877 |
| 4,726,450 | 2/1988 | Fossati et al. | 187/111 |
| 5,014,824 | 5/1991 | Fargo | 187/17 |
| 5,082,091 | 1/1992 | Fargo | 187/17 |
| 5,170,021 | 12/1992 | Martini | 187/393 |
| 5,212,951 | 5/1993 | Fargo et al. | 187/393 |
| 5,243,154 | 9/1993 | Tomisawa et al. | 187/393 |
| 5,281,774 | 1/1994 | Masaki | 187/393 |

FOREIGN PATENT DOCUMENTS

| | | | |
|---|---|---|---|
| 0162931 | 12/1985 | European Pat. Off. | B66B 1/24 |
| 0460583 | 12/1991 | European Pat. Off. | B66B 1/04 |
| 2221081 | 9/1990 | Japan . | |
| 3036181 | 2/1991 | Japan . | |
| 49302 | 2/1993 | Japan | 187/393 |
| 49306 | 6/1993 | Japan | 187/393 |
| 2201810 | 8/1988 | United Kingdom | B66B 1/00 |
| 8002135 | 10/1980 | WIPO | B66B 1/24 |

*Primary Examiner*—William E. Terrell
*Assistant Examiner*—Tamara Kelly

[57] ABSTRACT

A control system for controlling the motion of a hydraulic elevator calculates a deceleration distance based upon the elevator velocity and begins the deceleration phase of the elevator motion upon the elevator reaching the calculated distance from the landing. In a particular embodiment, the control system includes a hydraulic valve, a space encoder, and a controller. The space encoder produces velocity and position measurements. The controller uses the velocity inputs to determine the deceleration distance and, upon the elevator car 14 reaching the calculated distance from the landing as measured by the position inputs from the space encoder, commands the hydraulic valve to actuate and begin the deceleration phase. In an alternate embodiment, an interface unit connected between the controller and the hydraulic valve calculates a delay between the deceleration command based upon a predetermined distance and the calculated deceleration distance based upon car velocity. Upon expiration of the delay, the interface unit commands the hydraulic valve to actuate and begins the deceleration phase.

19 Claims, 3 Drawing Sheets

CONTROL SYSTEM FOR AN ELEVATOR

TECHNICAL FIELD

This invention relates to hydraulic elevator systems, and more particularly to control systems for controlling the motion of such elevators.

BACKGROUND OF THE INVENTION

Hydraulic elevators are commonly used instead of traction type elevators in low rise applications. The advantage of the hydraulic elevator is its lower cost. This advantage, however, may be offset by the lack of precision control of the ride as compared to traction elevators.

In a typical hydraulic elevator, the flow of fluid to and from a hydraulic cylinder causes the elevator car to ascend and descend within the hoistway. During the ascent operation, the fluid is pumped from a tank by a pump and flows through a control valve before entering the cylinder. During the descent operation, the control valve opens to permit the fluid to flow from the cylinder and into the tank under the pressure of the car. The motion profile of the elevator includes an acceleration phase, a full speed phase, a deceleration phase, and a leveling phase. In the leveling phase, the position of the elevator is corrected to level it with the landing. The leveling phase increases the flight time and the amount of work required of the hydraulic system and therefore it is desirable to minimize the leveling phase.

One type of hydraulic valve commonly used to transition between full speed and stopping, i.e., the deceleration phase of the elevator motion profile, includes a valve stem actuated by a solenoid to direct the flow of fluid through the valve. In this type of valve, the solenoid is activated to permit a flow of fluid into a cylinder closed off by a piston. Upon sufficicent pressurization of the cylinder, the piston will open to permit fluid flow through the valve and the car to descend. Balancing the fluid pressure on both sides of the valve prior to opening the valve provides a smooth and gentle start to the descent. A drawback to this type of valve is that the deceleration phase varies depending upon the hydraulic fluid viscosity and the static pressure in the hydraulic system (or the load on the hydraulic cylinder). This variation increases the amount of leveling necessary and, as a result, increases flight time, energy losses and the risk of overheating the hydraulic system.

A second type of transition valve includes a valve stem actuated by an electric motor. In this type of valve, flow is controlled by a stepper motor that moves a flow control valve. The amount of flow is programmed and controlled through feedback to produce a desired velocity profile for the elevator car. The purpose of the motor actuated control valve is to produce more precise control of the motion of the elevator car and thereby a smoother ride for the passengers that more closely approximates the ride of a traction type elevator. The main drawback to the motor actuated type of control valve is the additional complexity and cost associated with it.

The feedback to control the velocity profile may be open loop or closed loop. For open loop control, the hydraulic fluid temperature and static pressure are monitored and used to estimate a delay in carrying out the deceleration phase of the velocity profile. In this way, the control system attempts to compensate for viscosity variations of the hydraulic fluid. Since the delays are based upon predetermined estimates dependent upon parameters such as viscosity, the resulting performance of the control system in controlling the deceleration phase is less than optimal. For closed loop control of a motorized valve using car speed, high efficiencies can be achieved by constantly adjusting the valve position to approximate the desired velocity profile. The complexity of the control system and the added expense of this type of control may be prohibitive, however.

The above art notwithstanding, scientists and engineers under the direction of Applicant's Assignee are working to develop control systems to control the motion of elevators in a manner that optimizes flight time and efficiency without being cost prohibitive.

DISCLOSURE OF THE INVENTION

According to the present invention, a control system for a hydraulic elevator includes means to calculate a deceleration distance based upon elevator speed and a predetermined time period for the deceleration phase.

According to another embodiment, a method of controlling the motion of an elevator includes the steps of determining a deceleration distance based upon the velocity of the elevator and actuating the hydraulic valve upon the elevator reaching the deceleration distance from the landing.

Advantages of the invention include simplicity of the control system and minimized leveling time that results from calculating the deceleration distance based upon elevator speed. Using speed as the determining factor accounts for pressure, viscosity and pump flow rate variations without the need to force the elevator to have a predetermined velocity profile using a complex feedback type control system. Minimizing the leveling time results in minimizing the flight time, minimizing the energy losses that occur during leveling, and reduces the risk of the hydraulic fluid overheating.

According to a particular embodiment, the control system includes a controller that generates a deceleration command and an interface unit that calculates a delay. The deceleration command is generated at a predetermined distance from the landing. The delay is based upon the difference between the calculated deceleration distance and the predetermined distance. Upon the expiration of the delay subsequent to the deceleration command, the interface unit causes the hydraulic valve to close and begins the deceleration phase.

According to a further particular embodiment, a method of modifying a control system includes the step of connecting an interface unit between the controller and the hydraulic valve. The interface unit calculates the deceleration distance and the delay and causes the hydraulic valve to actuate upon the expiration of the delay subsequent to the controller generating the deceleration command.

Using a separate interface unit facilitates modifying an existing controller to use the control system of the invention. The interface unit receives the standard deceleration command from the existing controller, calculates the delay, and then triggers the hydraulic valve to actuate and begin the deceleration phase. The performance of existing elevators may be easily and inexpensively upgraded using the interface unit.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
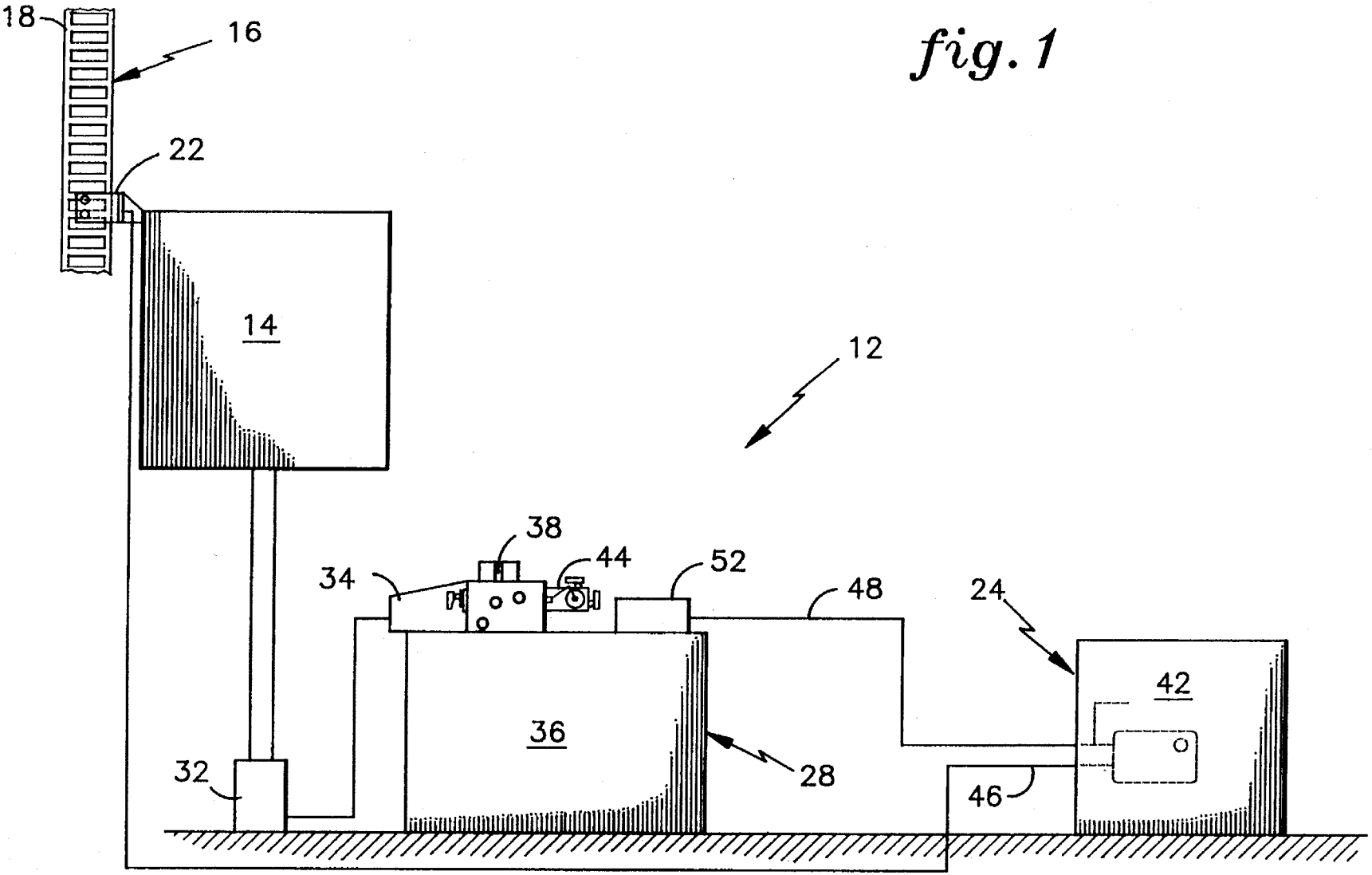
FIG. 1 is a schematic illustration of a control system for an elevator.

FIG. 1 illustrates a hydraulic elevator system 12 including a car 14, a space encoder system 16 including a tape 18 and a tape reader 22, and a control system 24. The car 14 is a conventional elevator car 14 that travels within a hoistway (not shown). The tape 18 is a perforated band 26 that extends throughout the hoistway. The tape reader 22 is mounted on the car 14 and is engaged with the tape 18. Engagement between the tape 18 and the tape reader 22 provides means to measure car velocity and means to determine the position of the car 14 relative to the landings disposed throughout the hoistway.

The control system 24 includes a hydraulic system 28 including a cylinder 32, a pump 34, a tank 36, a hydraulic valve 38, and a controller 42. The cylinder 32, pump 34 and tank 36 are conventional means to drive the elevator car 14 within the hoistway. The pump 34 moves hydraulic fluid between the tank 38 and the cylinder 32 to cause the car 14 to move up and down within the hoistway.

The hydraulic valve 38 controls the flow of hydraulic fluid into and out of the cylinder 32, thereby determining the velocity profile of the elevator car 14. Typical hydraulic valve 38 perform several functions, one of which is to transition the car 14 between stopping and full speed, i.e., the acceleration phase, and to transition the car 14 between full speed and leveling speed, i.e., the deceleration phase. This function is performed by a motor actuated transition valve 44 incorporated into the hydraulic valve 38. Actuating the transition valve 44 in a first direction begins the acceleration phase. Actuating the transition valve 44 in the opposite direction begins the deceleration phase.

The controller 42 includes means to calculate a deceleration distance based upon the velocity of the car 14. The controller 42 communicates with the tape reader 22 via a communication cable 46 extending therebetween. Velocity inputs from the tape reader 22 are used to determine the distance required to decelerate the car 14 to leveling speed within a predetermined time period. The time period is selected to optimize the comfort of the deceleration for the elevator passengers. The deceleration distance is continually updated during the travel of the car 14. Position inputs from the tape reader 22 are used in conjunction with landing-to-landing distances stored in the controller 42 to determine when the car 14 has reached the point in its travel such that the distance to the scheduled landing equals the determined deceleration distance. At that point, the controller 42 sends a signal to the transition valve 44, via a second communications cable 48 extending between the controller 42 and a terminal block 52, to actuate and thereby begin the deceleration phase. At this point the transition valve maintains a small orifice to permit hydraulic fluid flow for the leveling phase.

To further optimize the comfort of the passengers when the car 14 is in the leveling phase and at leveling speed, a second distance to the landing is determined. As with the deceleration distance, this second distance is based upon a predetermined stopping distance at a slow leveling speed. At this distance from the landing, the controller 42 sends a further signal to the transition valve 44. The motor actuates the transition valve 44 to further reduce the flow through the valve and result in the car reaching the second, slower leveling speed. Having a second, lower leveling speed minimizes the amount of stopping jerk perceived by the passengers in the car 14 when the car stops without significantly increasing the duration of the leveling phase.

By monitoring the distance and speed during the deceleration and leveling phases, hydraulic fluid pressure, viscosity and pump flow rate variations may be accounted for without the need for a complex feedback type control system.

Figure 2:
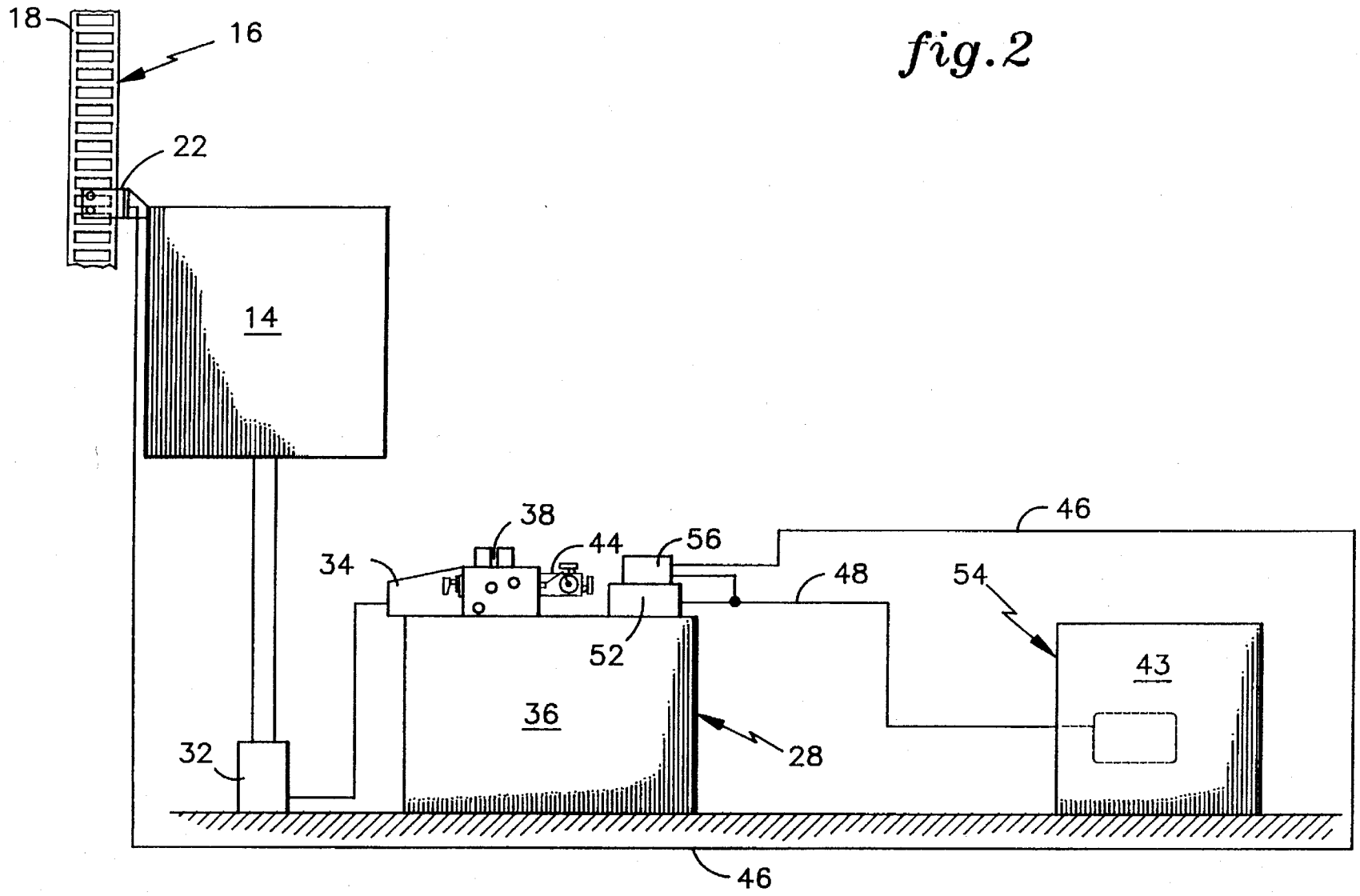
FIG. 2 is an alternate embodiment of the present invention, with the control system including an interface unit.

As shown in FIG. 1, the means to calculate the deceleration distance is incorporated into the controller 42. An alternate embodiment of the invention includes a control system 54 as shown in FIG. 2. This control system 54 includes the same hydraulic system 28 including the cylinder 32, pump 34, tank 38, and hydraulic valve 38. In this embodiment, however, a conventional controller 43 is used and the control system 54 further includes an interface unit 56. The conventional controller 43 includes means to generate a deceleration command based upon a predetermined distance of the elevator car 14 from the landing.

In the embodiment shown in FIG. 2, however, the deceleration command from the controller 43 is not sent directly to the transition valve 44 but is sent to the interface unit 56. The interface unit 56 also receives velocity and position inputs from the tape reader 22. The interface unit 56 uses the velocity input to calculate the deceleration distance based upon the car velocity. Upon receiving the deceleration command from the controller 43, the interface unit 56 then calculates the difference between the actual car position and the calculated deceleration distance. This difference is a delay. The interface unit 56 triggers the transition valve 44 to actuate and begin the leveling phase upon the expiration of this delay.

During the leveling phase, a second distance to the landing is determined and, at this distance, the interface unit 56 triggers the transition valve 44 to move and the car 14 travels at the second, slower leveling speed.

Using the interface unit 56 provides a method to modify a conventional control system to receive the benefits of the invention. The method includes the steps of connecting the interface unit 56 between the conventional controller 43 and the hydraulic valve 38 and connecting the tape reader 22 speed and position outputs to the interface unit 56. The connection between the controller 43 and the interface unit 56 is such that the deceleration command generated by the controller 43 is directed to the interface unit 56 rather than the transition valve 44. The interface unit 56, after calculating the delay based upon measured car speed, will then actuate the transition valve 44 upon expiration of the delay. If the conventional control system includes a solenoid actuated transition valve, further benefits may be received by also replacing the solenoid actuated valve with a motor actuated transition valve.

Figure 4:
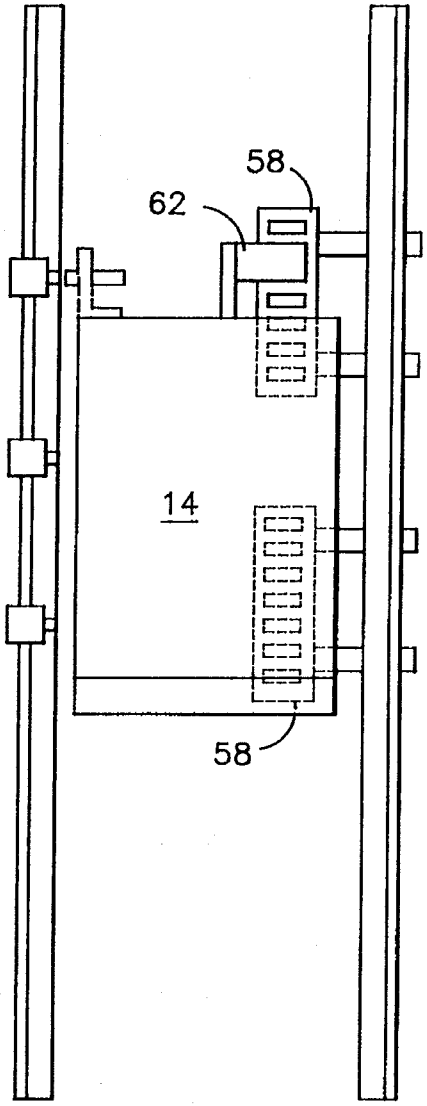
FIG. 4 is a rotating space encoder and a triggering device.
Figure 3:
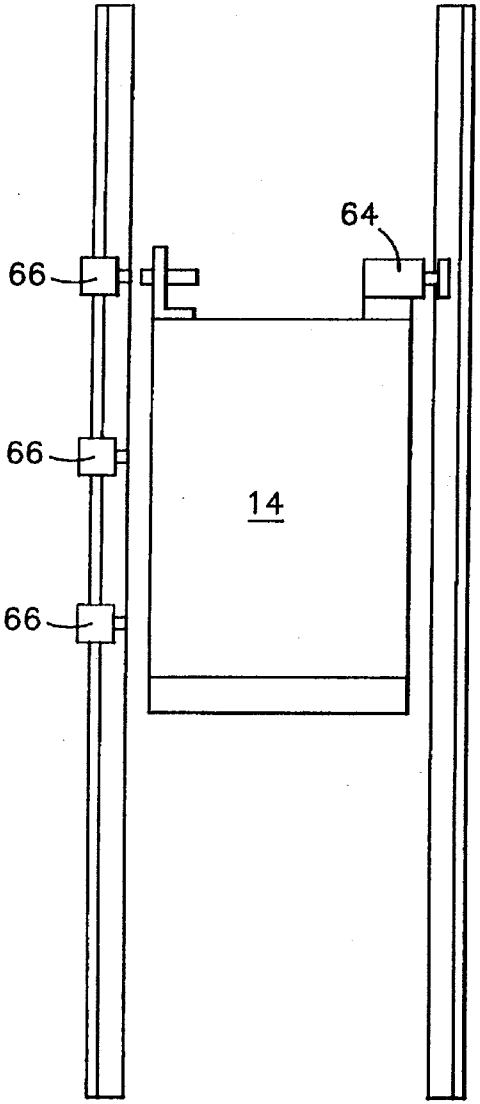
FIG. 3 is a space encoder including a plurality of segmented, perforated bands and a tape reader.

Although shown as a single, extending perforated band 26, other means to determined position and velocity may be used, such as a plurality of segmented, perforated bands 58 positioned proximate to the landings, as shown in FIG. 4. In this embodiment, once the deceleration command is generated the velocity and position inputs from the tape reader 62 are used to determine the delay. Another embodiment shown in FIG. 3 uses a rotating space encoder 64 combined with a plurality of triggering devices 66 positioned within the hoistway a predetermined distance from the landings. In the latter embodiment, the devices 66 trigger the control system to generate the deceleration command.

Although the invention has been shown and described with respect to exemplary embodiments thereof, it should be understood by those skilled in the art that various changes, omissions, and additions may be made thereto, without departing from the spirit and scope of the invention.

What is claimed is:

1. A control system for controlling the motion of a hydraulic elevator traveling to a landing, the motion of the elevator including a deceleration phase occurring prior to stopping at the landing, the control system including:

a hydraulic valve, wherein actuation of the hydraulic valve begins the deceleration phase of the elevator motion;

means to measure the velocity of the elevator;

means to determine the position of the elevator relative to the landing;

means to calculate a deceleration distance based upon the measured velocity and a predetermined time period for the deceleration phase; and means to actuate the hydraulic valve upon the elevator reaching the calculated distance from the landing.

2. The control system according to claim 1, wherein the means to actuate the hydraulic valve includes a controller that generates a deceleration command based upon a predetermined distance of the elevator from the landing, wherein the means to calculate the deceleration distance includes an interface unit engaged with the hydraulic valve and the controller, the interface unit calculating a delay based upon the difference between the calculated deceleration distance and the predetermined distance, and wherein the hydraulic valve actuates upon the expiration of the delay after the deceleration command is generated.

3. The control system according to claim 2, the control system including a space encoder that defines the means to measure the velocity of the elevator and the means to determine the position of the elevator.

4. The control system according to claim 3, wherein the space encoder is a linear space encoder including a plurality of perforated bands disposed proximate to the landings.

5. The control system according to claim 2, wherein the means to determine position including a device positioned within the hoistway the predetermined distance from the landing, the device triggering the controller to generate the deceleration command.

6. The control system according to claim 5, wherein the means to measure velocity includes a rotating space encoder.

7. The control system according to claim 1, the control system including a space encoder and a controller, the space encoder defining the means to measure the velocity of the elevator and the means to determine the position of the elevator, the controller being engaged with the hydraulic valve and including stored information including the distances separating landings, and wherein the controller defines the means to calculate the deceleration distance based upon the measured speed and the determined position.

8. The control system according to claim 1, further including:

means to calculate a second distance to the landing based upon the measured velocity and a predetermined time period for a leveling phase; and means to actuate the hydraulic valve upon the elevator reaching the second calculated distance from the landing.

9. A method of controlling the motion of an elevator traveling to a landing, the motion of the elevator including a deceleration phase occurring prior to stopping at the landing, the elevator including a control system having a hydraulic valve, wherein actuation of the hydraulic valve begins the deceleration phase of the elevator motion, the method including the steps of:

measuring the velocity of the elevator;

determining the position of the elevator relative to the landing;

determining a deceleration distance based upon the measured velocity and a predetermined time period for the deceleration phase; and actuating the hydraulic valve upon the elevator reaching the determined distance from the landing.

10. The method according to claim 9, wherein the means to actuate the hydraulic valve includes a controller that generates a deceleration command based upon a predetermined distance of the elevator from the landing, wherein the means to calculate the deceleration distance includes an interface unit engaged with the hydraulic valve and the controller, the interface unit calculating a delay based upon the difference between the calculated deceleration distance and the predetermined distance, and further including the steps of:

generating the deceleration command;

determining the delay; and actuating the hydraulic valve upon the expiration of the delay after the deceleration command is generated.

11. The method according to claim 10, wherein the means to determine position including a device positioned within the hoistway the predetermined distance from the landing, and further including the step of triggering the controller to generate the deceleration command upon the elevator reaching the device.

12. The control system according to claim 9, wherein the means to calculate the deceleration distance includes a controller, the controller being engaged with the hydraulic valve and including stored information including the distances separating landings, and the method further including the step of comparing the distance to the landing with the determined deceleration distance and actuating the hydraulic valve when the distance remaining equals the determined deceleration distance.

13. The method according to claim 9, further including the steps of:

determining a second distance to the landing based upon the measured velocity and a predetermined time period for a leveling phase; and actuating the hydraulic valve upon the elevator reaching the second determined distance from the landing.

14. A method to modify a control system for an elevator, the control system having a controller and a hydraulic valve, the control system controlling the motion of the elevator including a deceleration phase occurring prior to stopping at the landing, wherein actuation of the hydraulic valve determines the onset of the deceleration phase and is caused by a deceleration command from the controller, the controller generating the deceleration command based upon a predetermined distance of the elevator from the landing, the method including the step of:

connecting an interface unit between the controller and the hydraulic valve, the interface unit calculating the deceleration distance based upon speed and position parameters and determining a delay based upon the difference between the calculated deceleration distance and the predetermined distance such that the interface unit causes the hydraulic valve to actuate upon the expiration of the delay subsequent to the controller generating the deceleration command.

15. The method according to claim 14, wherein the hydraulic valve includes a hydraulically piloted, solenoid actuated transition valve, and further including the step of:

replacing the hydraulically piloted, solenoid actuated valve with a motor actuated hydraulic valve.

16. The method according to claim 14, further including the steps of:

connecting means to measure the speed of the elevator to the interface unit; and connecting means to determine the position of the elevator to the interface unit.

17. An interface unit in an elevator system, the elevator system including a control system for controlling the motion of the elevator, the control system including a controller, a hydraulic valve, means to measure the speed of the elevator, and means to determine the position of the elevator, the interface unit including:

means to calculate a deceleration distance based upon the measured velocity and a predetermined time period for the deceleration phase; and means to actuate the hydraulic valve upon the elevator reaching the calculated distance from the landing.

18. The interface unit according to claim 17, wherein the controller generates a deceleration command based upon a predetermined distance of the elevator from the landing, and wherein the interface unit calculates a delay based upon the difference between the calculated deceleration distance and the predetermined distance, such that the hydraulic valve actuates upon the expiration of the delay after the deceleration command is generated.

19. The interface unit according to claim 17, further including:

means to calculate a second distance to the landing based upon the measured velocity and a predetermined time period for a leveling phase; and means to actuate the hydraulic valve upon the elevator reaching the second calculated distance from the landing.

* * * * *